US005312061A

United States Patent [19]

McCormick

[11] Patent Number: 5,312,061

[45] Date of Patent: May 17, 1994

[54] CLAMPING MECHANISM FOR SECURING A ROPE TO A WINCH DRUM

[75] Inventor: Stephen J. McCormick, Shorewood, Wis.

[73] Assignee: Harnischfeger Corporation, Brookfield, Wis.

[21] Appl. No.: 4,121

[22] Filed: Jan. 13, 1993

[51] Int. Cl.[5] ..... B65H 75/28

[52] U.S. Cl. ..... 242/117

[58] Field of Search ..... 242/115, 116, 117, 118, 242/77, 77.1, 77.3, 125.1, 74; 254/DIG. 14

[56] References Cited

U.S. PATENT DOCUMENTS

| | | | |
|---|---|---|---|
| 1,555,544 | 9/1925 | Anthony | 242/117 |
| 1,836,067 | 12/1931 | Faulkner et al. | 242/117 |
| 2,193,407 | 3/1940 | Hagen | 242/117 |
| 2,329,943 | 9/1943 | Rebins | 242/117 |
| 2,358,580 | 9/1944 | Leonard | 242/117 |
| 2,811,322 | 10/1957 | Wilkinson | 242/117 |
| 2,846,162 | 8/1958 | Allin, Sr. et al. | 242/117 |
| 2,860,006 | 11/1958 | Schonrock | 242/117 |
| 2,892,598 | 6/1959 | Dudley | 242/117 |
| 3,135,478 | 6/1964 | Harlander | 242/117 X |
| 3,494,595 | 2/1970 | Bohan | 242/117 |
| 3,534,920 | 10/1970 | McGrath et al. | 242/117 |
| 4,210,295 | 7/1980 | Brusselle | 242/125.1 |
| 4,715,549 | 12/1987 | Travlos | 242/117 X |
| 4,753,399 | 6/1988 | Baum | 242/117 |
| 4,880,182 | 11/1989 | Gelfman | 242/117 |
| 4,953,829 | 9/1990 | Knaack et al. | 242/117 X |

*Primary Examiner*—Joseph J. Hail, III
*Assistant Examiner*—John P. Darling
*Attorney, Agent, or Firm*—Michael, Best & Friedrich

[57] ABSTRACT

A clamping mechanism for releaseably securing the end of a rope to a winch drum. The winch drum includes first and second walls that are spaced apart in facing relation to each other to define therebetween a rope end receiving space having open front and rear ends. One of the walls in the space is contactable by the rope end that is to be secured to said winch drum. A clamping wedge member has an axis, a drum side contactable with the other of the winch drum walls, a rope side contactable with the rope end, and a drive end to which a first axial force can be applied. Application of the first axial force moves the wedge member axially into the space and causes a first lateral clamping force be applied, initially clamping the rope end against the one wall. A transverse thrust device is mounted on the drum for applying a transverse force against the drum side of the wedge member transversely of the wedge axis to cause a second lateral clamping force to be exerted against the rope end.

18 Claims, 2 Drawing Sheets

CLAMPING MECHANISM FOR SECURING A ROPE TO A WINCH DRUM

BACKGROUND OF THE INVENTION

The present invention relates to a clamping mechanism for securing an end of a rope to a winch drum.

Winches typically have a power driven, rotatable winch drum to which one end of a rope, usually fabricated out of wire, is secured. The other or free end of the wire rope is secured to the load that is to be moved or lifted. Such winches are frequently used to move extremely heavy loads which may exceed 70 tons and it is very difficult to securely attach the rope end to the winch drum in a manner that will prevent its slipping free when subjected to high tension forces caused by such heavy loads.

The winch drum is normally provided with an open ended compartment having spaced apart sidewalls and open front and rear ends. One end of the wire rope is inserted through the open front end of the compartment to lie in contact along one of the walls. A wedge member is then placed between the rope and the other wall of the compartment. The next step is to initially "set" the wedge to clamp the wire rope between the wedge and drum sidewall with enough lateral force to increase the friction between the wedge and the rope to a magnitude such that tension on the wire rope will tend to pull the wedge further into the compartment and create a wedging action against the wire rope end that will prevent its slipping free under full load. If the wedge is not properly set the rope end will slip free, allowing the load to fall or otherwise move freely with potential damage. The wedge is "set" by placing a driver, such as a punch, into the rear end of the compartment against the wide end of the wedge and then driving it further into the compartment with a series of powerful hammer blows to the punch. This clamps the wire rope end between the wedge and drum wall.

In theory, setting the wedge is a simple act. In actual practice setting the wedge can be difficult and time consuming. Four independent components, (rope end, wedge, driver and hammer) have to be simultaneously handled. The rope end and wedge must be inserted into the compartment, accurately aligned axially of each other in the compartment and then held in such alignment while the driver is placed against the wide end of the wedge. With these three components held in loose alignment with one hand the installer must then swing the hammer with accurate and powerful blows to drive the wedge into its initial set position.

The initial setting of the wedge is made more difficult when the winch is located in a small restricted compartment. For example, in a tank retrieval vehicle (used to "tow" military tanks), the winch is in a restricted compartment which is enclosed, thus placing the winch in almost total darkness even during daylight conditions. Not only is it difficult to see the wedge, the space available for the winch is such that it is also difficult to find room to swing the hammer. Under battle conditions time is of the essence, and with known designs reattaching the end of a broken rope can take too long, with undue risk that the rope attachment will fail under full load.

If the wire rope breaks, removal of the wedge to release the wire rope end is also difficult. A punch must be inserted through the open front end of the compartment and hit with a hammer to unseat the wedge.

SUMMARY OF THE INVENTION

A need exists for an improved clamping mechanism which will not require a high degree of installation skill, and in which the wedge can be quickly and securely initially set or unset without need to see the wedge.

The invention provides an improved clamping mechanism for securing a rope end to a winch drum.

A first embodiment of the clamping mechanism is incorporated in a winch drum that has first and second walls spaced apart in opposed facing relation to each other to define therebetween a rope end receiving space having open front and rear ends. The end of the wire rope is placed in the space to lie against one of the drum walls, leaving a gap between the wire rope and the other drum wall. In the first embodiment a wedge member having a drum side, a rope side and a drive end is placed in the gap with the wedge member's drum side against the other drum wall and its rope side against the rope. The drive end of the wedge member is adapted to receive a first axial force for causing the wedge to move axially and exert an initial or a first lateral clamping force against the rope. A thrust means is mounted on the winch drum for applying a lateral thrust force against the drum side of the wedge and thereby moving it transversely to cause a second lateral clamping force to be exerted against the rope. The thrust means preferably includes two clamp screws threadably mounted in the drum to extend transversely to the wedge and into engagement with the drum side of the wedge.

A second embodiment of the clamping mechanism is also incorporated in the same type of winch drum as previously described with respect to the first embodiment. In the second embodiment an abutment means is provided on the winch drum adjacent the open rear end of the rope end receiving space. An extensible first axial force generating means, preferably in the form of a driving screw, is mounted between the abutment means and the drive end of the wedge member to apply the first axial force to move the wedge axially into the space and exert the initial or first lateral clamping force on the rope end. Thrust means are provided as previously explained with regard to the first embodiment to apply the second lateral clamping force to the wedge.

Either embodiment may be provided with a cam arrangement for applying a second axial force to the wedge member. Preferably, one of the clamp screws has a tapered end, and the wedge member has an angular cam surface terminating at a stop portion. Turning the clamp screw places the tapered end thereof in contact with the angular cam surface to apply the second axial force to the wedge until the cam face follower contacts the stop portion, after which continued turning of the clamp screw then generates the second lateral clamping force.

Figure 1:
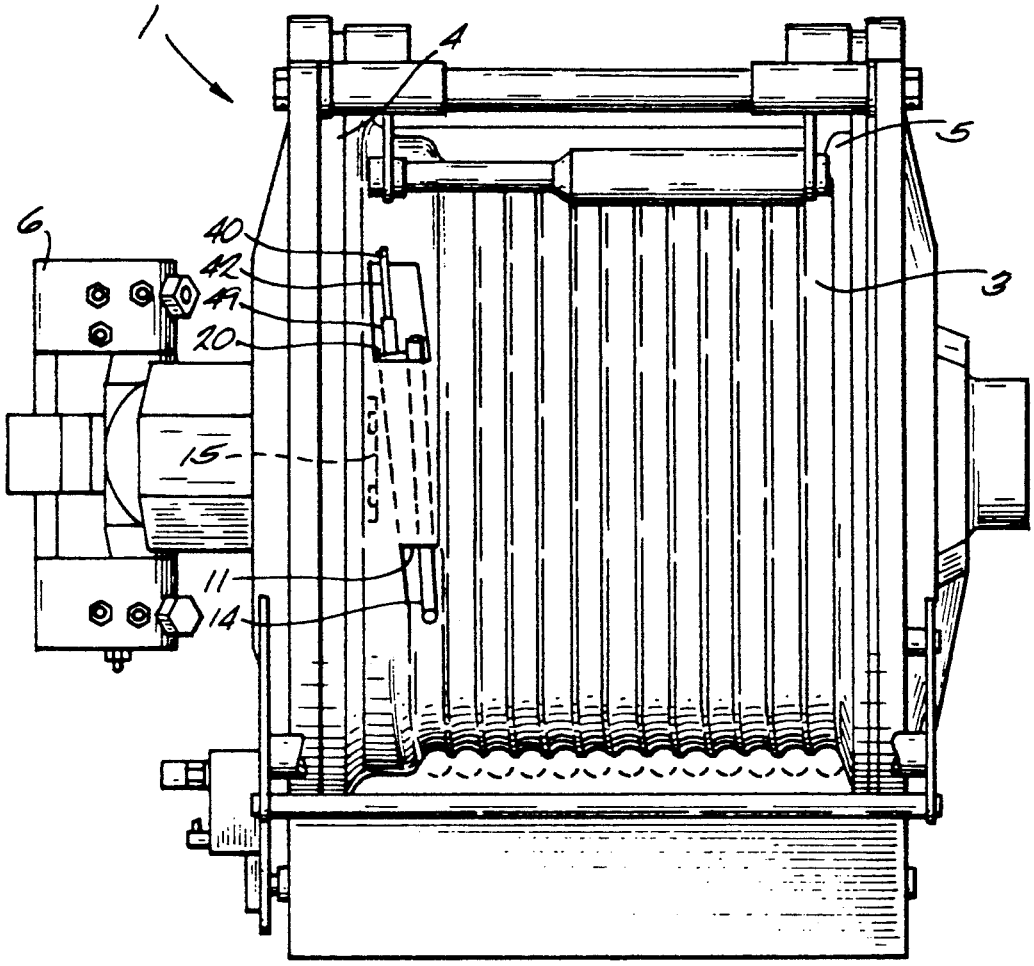
FIG. 1 is a top view of a winch in which the clamping mechanism of the invention is incorporated.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENTS

First Embodiment

Figure 3:
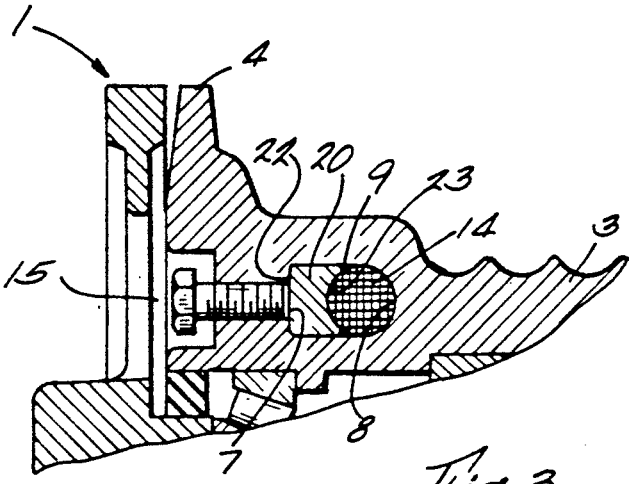
FIG. 3 is a section taken along lines 3—3 of FIG. 2.
Figure 2:
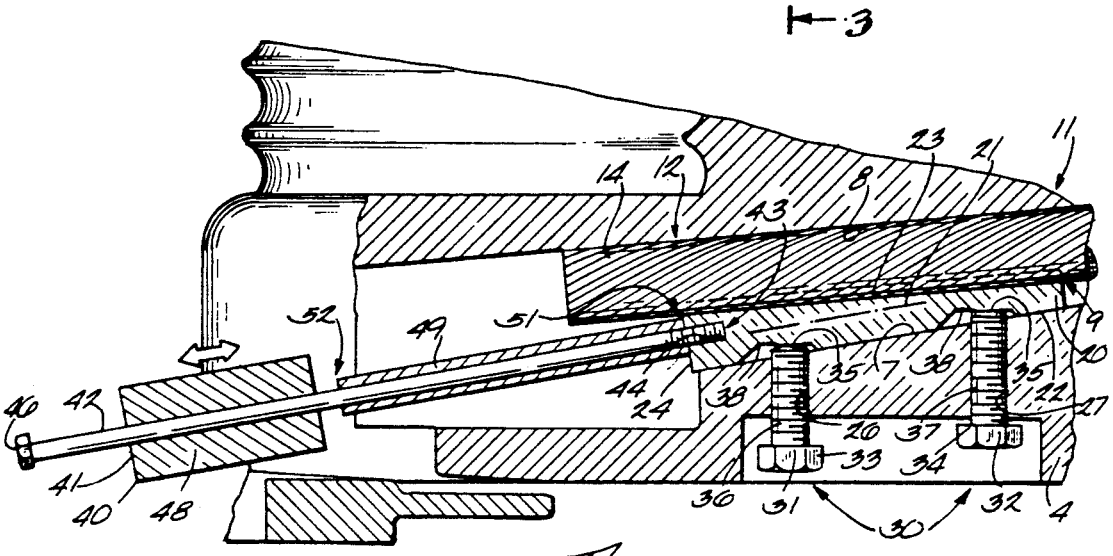
FIG. 2 is an enlarged partial view of the winch, partially in section, showing a first embodiment of the clamping mechanism.

FIG. 1 shows a winch 1 comprising a winch drum 3 having end flanges 4 and 5. The winch drum 3 is rotated in opposite directions by a prime mover actuated in known manner. Referring now to FIGS. 2 and 3 the drum end flange 4 includes drum walls 7 and 8 that are spaced apart in facing relation to each other to define a rope end receiving space 9 having opposed open front and rear ends 11 and 12 into which the end 14 of a wire rope is clamped. The drum walls 7 and 8 are angularly oriented relative to each other to provide a taper to space 9 which increases in width from the front end 11 to the rear end 12.

Referring to FIGS. 2 and 3, the winch 1 also comprises a rope clamping mechanism 15 includes a clamping wedge member 20 having an axis 21, a flat drum side 22, a concave rope side 23 and a drive end 24. The wedge 20 has an angle of taper that will present the rope side 23 thereof in spaced parallel relation to drum wall 8 when the drum side 22 of the wedge 20 is in contact with drum wall 7. The wall 7 of drum end flange 4 is provided with two internally threaded bores 26 and 27. A thrust means 30 is provided for applying a lateral thrust force on wedge 20. The thrust means 30 preferably includes clamp screws 31 and 32 having heads 33, 34 and threaded portions 36, 37 that are threaded into bores 26 and 27 so that the clamp screws 31 and 32 extend transversely relative to the wedge axis 21. The end 35 of each of the threaded portions 36, 37 is in engagement with flat seats 38 on the drum side of clamping wedge 20.

Referring to FIG. 2, a first axial drive force generating means 40 is detachably mounted on the drive end 24 of wedge 20. The first drive force generating means preferably comprises a slide hammer 41 including a guide element or bolt 42 having an externally threaded end 43 threaded into an internally threaded bore 44 in the drive end 24 of wedge 20. The bolt 42 also has a head 46. A drive sleeve 49 having inner and outer ends 51, 52 is slidably mounted on bolt 42. A hammer 48 is also slidably mounted on bolt 42 between head 46 and outer end 51 of drive sleeve 49.

In operation the rope end 14 is placed in space 9 to be in contact with drum wall 8, leaving a gap between rope end 14 and the other drum wall 7. The clamping wedge 20 is placed in the gap between rope end 14 and wall 7, and the bolt 42 is threaded into wedge drive end 24. Hammer 48 is reciprocated to impact against sleeve end 52 to drive the clamping wedge 20 further into space 9, causing it to exert a first lateral clamping force that urges the rope end 14 against wall 8 and initially sets wedge 20. The clamp screws 31 and 32 are then tightened to apply a lateral thrust force against the clamping wedge 20 to cause an additional lateral clamping force to be exerted against the rope end 14. The lateral thrust force exerted on the clamping wedge 20 by the screws 31 and 32 is independent of the force exerted on the wedge 20 by drum wall 7 in response to the axial force exerted on wedge 20 by hammer 48. The bolt 42 is then unthreaded from the clamping wedge 20.

If the rope 14 breaks the bolt 42 is reinstalled, clamp screws 31 and 32 loosened and hammer 48 reciprocated to impact against head 46. This impact moves wedge 20 to the left in FIG. 2 and unseats it to allow rope end 14 to be withdrawn.

Second Embodiment

Figure 4:
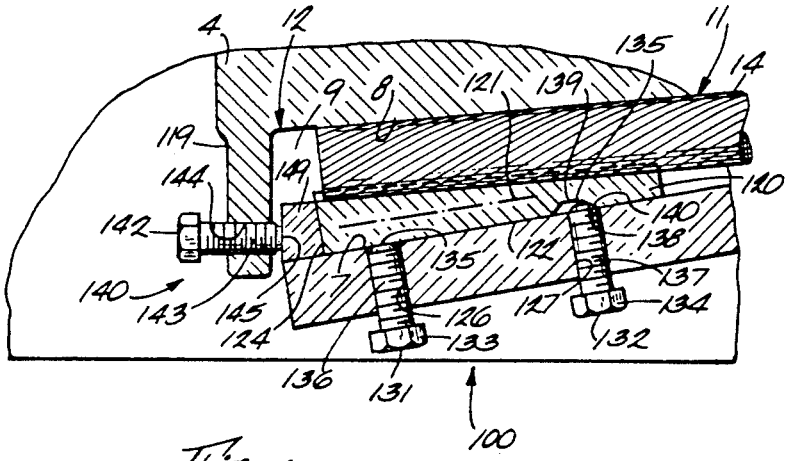
FIG. 4 is a partial view similar to FIG. 2 showing a second embodiment of the clamping mechanism.

A clamping mechanism 100 that is a second embodiment of the invention is shown in FIG. 4. The clamping mechanism 100 can also be installed in the winch 1 previously described. Accordingly, the same numbers will be used for the winch components referred to in describing the clamping mechanism 100.

The clamping mechanism 100 includes an abutment means 119 which extends from drum flange 4 proximal the open rear end 12 of space 9. The abutment means 119 could be integral with flange 4 as shown or be a separate member detachably mounted on flange 4. An extensible axial drive force generating means 140 is mounted between the abutment means 119 and a drive end 124 of a clamping wedge 120. The extensible drive force generating means 140 comprises a drive screw 142 having a first portion 143 threaded into an internally threaded bore 144 in the abutment means 119 and a second end portion 145 in contact with wedge end 124. Preferably, a drive force transmitting means 149 in the form of a secondary wedge 149 is interposed between the end of drive screw 142 and the wedge drive end 124. Alternatively, the end portion of drive screw 142 can contact wedge drive end 124 directly. In another alternative embodiment, the drive screw 142 can be threaded into the wedge 120 and have an end engaging the abutment means 119.

The wall 7 of drum end flange 4 is provided with two internally threaded bores 126, 127. A thrust means 130 is provided for initially applying a second axial force on wedge 120 and then applying a second lateral clamping force as explained with regard to the first embodiment. The thrust means 130 comprises clamp screws 131, 132 having heads 133, 134 and threaded portions 136, 137 threaded into bores 126, 127 so that the clamp screws 131, 132 extend transversely relative to the axis 121 of wedge 120. The end 135 of clamp screw 131 engages drum side 122 of wedge 120. The wedge 120 is provided with a planar cam face 138 orientated at an angle to wedge axis 121. The cam face 138 terminates at a stop portion 139 parallel to wedge axis 121. The clamp screw 132 is tapered adjacent its end 135 and has a camming surface 140 that engages cam face 138.

The operation of the clamping mechanism 100 is basically the same as that of the first embodiment. The rope end 14 and clamping wedge 120 are placed in space 9. The driving screw 142 is threaded into abutment 119 so as to apply a first axial force moving wedge 120 further into space 9 and cause the first lateral clamping force to be applied to rope end 14. The clamp screws 131 and 132 are then threaded into their respective bores 126, 127 and against the wedge 120. The initial contact of camming surface 140 with cam face 138 applies a second axial force causing the clamping wedge 120 to move even further into the space 9 and exert an additional lateral clamping force on rope end 14. When the end 135 of clamp screw 132 contacts the wedge stop portion 139, further threading of screw 132 generates the second lateral clamping force that supplements the first lateral clamping force.

Various features of the invention are set forth in the following claims.

I claim:

1. A winch mechanism comprising:

a winch drum including first and second walls spaced apart in facing relation to each other to define therebetween a rope end receiving space having opposed open front and rear ends with one of said walls contactable by a rope end that is to be secured to said winch drum;

a clamping wedge member having an axis, a drum side contactable with the other of said winch drum walls, a rope side contactable with the rope end inserted through said front end, and a drive end adjacent said rear end to which a first axial force can be applied for moving said clamping wedge member axially into said space and exerting on the rope end a first lateral clamping force that will urge the rope end against said one of said walls; and a thrust means mounted on said drum for applying a lateral thrust force against said wedge member transversely of said axis to cause a second lateral clamping force to be exerted against the rope end and toward said one of said walls, said lateral thrust force being independent of the force exerted on said wedge member in response to said first axial force.

2. The winch mechanism according to claim 1 further comprising a first axial drive force generating means detachably connected to said clamping wedge member for moving said clamping wedge member into said space.

3. The winch mechanism according to claim 1 wherein:

said clamping wedge member has a cam face thereon; and said thrust means includes means for engagement with said cam face for applying a second axial force to move said clamping wedge member further into said space.

4. The winch mechanism according to claim 1 wherein:

an abutment member is mounted on said winch drum proximal said open rear end; and an extensible axial drive force generating means is mounted between said abutment member and said clamping wedge member drive end for applying said first axial force to move said clamping wedge member axially into said space.

5. A winch mechanism comprising:

a winch drum including first and second walls spaced apart in facing relation to each other to define therebetween a rope end receiving space having opposed open front and rear ends with one of said walls contactable by a rope end that is to be secured to said winch drum;

a clamping wedge member having an axis, a drum side contactable with the other of said winch drum walls, a rope side contactable with the rope end inserted through said front end, and a drive end adjacent said rear end to which a first axial force can be applied for moving said clamping wedge member axially into said space and exerting on the rope end a first lateral clamping force that will urge the rope end against said one of said walls; and a first axial drive force generating means detachably connected to said clamping wedge member for moving said clamping wedge member into said space, said first axial drive force generating means including a slide hammer having a guide element detachably mounted on said wedge member drive end, and a hammer slidably mounted on said guide element for reciprocating movement into contact with sad drive end to drive said clamping wedge member into said space.

6. The winch mechanism according to claim 5 wherein said guide element has a hammer stop in spaced relation to said wedge member drive end, and said hammer is slidably mounted on said guide element to apply axial force either to said wedge member drive end to drive said clamping wedge member into said space or to said hammer stop to drive said clamping wedge member out of said space.

7. A winch mechanism as set forth in claim 5 and further comprising a thrust means mounted on said drum for applying a lateral thrust force against said wedge member transversely of said axis to cause a second lateral clamping force to be exerted against the rope end and toward said one of said walls, said lateral thrust force being independent of the force exerted on said wedge member in response to said first axial force.

8. A winch mechanism comprising:

a winch drum including first and second walls spaced apart in facing relation to each other to define therebetween a rope end receiving space having opposed open front and rear ends with one of said walls contactable by a rope end that is to be secured to said winch drum;

a clamping wedge member having an axis, a drum side contactable with the other of said winch drum walls, a rope side contactable with the rope end inserted through said front end, and a drive end adjacent said rear end to which a first axial force can be applied for moving said clamping wedge member axially into said space and exerting on the rope end a first lateral clamping force that will urge the rope end against said one of said walls; and a thrust means mounted on said drum for applying a lateral thrust force against said wedge member transversely of said axis to cause a second lateral clamping force to be exerted against the rope end, said lateral thrust force being independent of the force exerted on said wedge member in response to said first axial force, said thrust means including at least one clamp screw threadably mounted in said other of said drum walls to extend transversely relative to said axis and into engagement with said drum side of said clamping wedge member to generate said second clamping force.

9. A winch mechanism comprising:

a winch drum including first and second walls spaced apart in facing relation to each other to define therebetween a rope end receiving space having opposed open front and rear ends with one of said walls contactable by a rope end that is to be secured to said winch drum;

a clamping wedge member having an axis, a drum side contactable with the other of said winch drum walls, a rope side contactable with the rope end inserted through said front end, and a drive end adjacent said rear end to which a first axial force can be applied for moving said clamping wedge member axially into said space and exerting on the rope end a first lateral clamping force that will urge the rope end against said one of said walls, said clamping wedge member having a cam face thereon, said cam face being on said drum side of said clamping wedge member; and a thrust means mounted on said drum for applying a lateral thrust force against said wedge member transversely of said axis to cause a second lateral clamping force to be exerted against the rope end, said lateral thrust force being independent of the force exerted on said wedge member in response to said first axial force, said thrust means including means for engagement with said cam face for applying a second axial force to move said clamping wedge member further into said space, said thrust means including a clamp screw which is threadably mounted on said other of said drum walls and which has a camming surface in engagement with said cam face.

10. The winch means according to claim 9 wherein:

said cam face is a planar surface which is orientated at an angle relative to said clamping wedge axis and which terminates at a stop portion; and said clamp screw extends transversely of said clamping wedge axis with said camming surface in engagement with said cam face surface such that movement of said screw toward said stop portion applies said second axial force to said clamping wedge member until said clamp screw contacts said stop portion after which continued movement of said clamp screw generates said second clamping force.

11. A winch mechanism comprising:

a winch drum including first and second walls space apart in facing relation to each other to define therebetween a rope end receiving space having opposed open front and rear ends with one of said walls contactable by a rope end that is to be secured to said winch drum;

a clamping wedge member having an axis, a drum side contactable with the other of said winch drum walls, a rope side contactable with the rope end inserted through said front end, and a drive end adjacent said rear end to which a first axial force can be applied for moving said clamping wedge member axially into said space and exerting on the rope end a first lateral clamping force that will urge the rope end against said one of said walls;

an abutment member mounted on said winch drum proximal said open rear end; and an extensible axial drive force generating means mounted between said abutment member and said clamping wedge member drive end for applying said first axial force to move said clamping wedge member axially into said space, said extensible axial drive force generating means including a driving screw having a first portion threaded into one of said abutment and wedge members and a second portion in contact with the other of said abutment and wedge members.

12. The winch mechanism according to claim 11 wherein an axial drive force transfer means is mounted between said driving screw and said drive end of said wedge member.

13. A winch mechanism as set forth in claim 11 and further comprising a thrust means mounted on said drum for applying a lateral thrust force against said wedge member transversely of sad axis to cause a second lateral clamping force to be exerted against the rope end and toward said one of said walls, said lateral thrust force being independent of the force exerted on said wedge member in response to said first axial force.

14. A winch mechanism comprising:

a winch drum having a wall partially defining a rope end receiving space;

a clamping wedge member having an axis and a wide end and being dimensioned to be mountable in said space to lie in confronting relation to a rope end placed in said space, said wide end being adapted to receive an axial force for driving said clamping wedge member axially into said space and into engagement with the rope end to exert thereon a lateral clamping force directed toward said wall; and a transverse thrust means mounted on said drum for exerting on said clamping wedge a lateral thrust force transverse to said wedge axis and toward said wall, said lateral thrust force being independent of the force exerted on said wedge member in response to the axial force.

15. The winch mechanism according to claim 14 and further comprising an axial force generating means connected to said wide end of said wedge for driving said clamping wedge member axially into said space and into engagement with the rope end to exert a lateral clamping force thereon.

16. The winch mechanism according to claim 15 wherein said axial drive force generating means is detachably connected to said clamping wedge member.

17. The winch mechanism according to claim 14 wherein said thrust means includes a clamp screw threaded into said drum transversely to said axis of said wedge member.

18. A winch comprising:

a support;

a winch drum which is rotatably mounted on said support and which includes a wall partially defining a rope end receiving space in said winch drum;

a clamping wedge having an axis and a wide end, said wedge being dimensioned to be mountable in said space to lie in confronting relation to a rope end that is placed into said space;

an axial force generating means connectable to said wide end of said wedge for driving said wedge axially into said space and into engagement with the rope end to exert thereon a first lateral clamping force directed toward said wall; and a transverse thrust generating means mounted on said drum for exerting on said wedge a lateral thrust force transverse to said wedge axis and toward said wall so that said wedge exerts a second lateral clamping force on the rope end.

* * * * *